US006030147A

United States Patent [19]

Bowden

[11] Patent Number: 6,030,147

[45] Date of Patent: Feb. 29, 2000

[54] TORSO-CONFORMING RELEASABLE DIVER'S WEIGHT POUCH

[75] Inventor: William A. Bowden, Glenview, Ill.

[73] Assignee: Dacor Corporation, Norwalk, Conn.

[21] Appl. No.: 09/039,070

[22] Filed: Mar. 13, 1998

[51] Int. Cl.[7] ..... B63C 11/02

[52] U.S. Cl. ..... 405/186; 441/106

[58] Field of Search ..... 405/186, 185; 114/315; 441/102, 106, 108; 224/191, 211

[56] References Cited

U.S. PATENT DOCUMENTS

| | | | |
|---|---|---|---|
| 4,068,657 | 1/1978 | Kobzen . | |
| 4,305,685 | 12/1981 | Rentfrow | 405/186 |
| 4,789,270 | 12/1988 | Selisky | 405/186 |
| 4,798,497 | 1/1989 | Bloos | 405/186 |
| 4,887,932 | 12/1989 | Toth | 405/186 |
| 5,011,334 | 4/1991 | Vorhauer | 405/186 |
| 5,076,575 | 12/1991 | Eylander | 405/186 X |
| 5,522,679 | 6/1996 | Eungard . | |
| 5,641,247 | 6/1997 | Seligman . | |
| 5,803,667 | 9/1998 | Seligman | 405/186 |

OTHER PUBLICATIONS

Zeagle 1994 Catalog entitled "Buoyancy Compensators Regulators & Accessories", Zeagle Systems, Inc., Zephyrhills, Florida, pertinent pages including 1) Zeagle Options (pull–out and zip–touch fastener wight release systems); 2) 7203 Series.

Concept, The Original Integrated Full Weight Buoyancy Compensator; 3) 7100Z Series & 7100P Series Beta, Great Basic Travel BC and New and Easy Weight Release Systems; 4) Ripcord weight release system.

*Primary Examiner*—Dennis L. Taylor

*Attorney, Agent, or Firm*—Greer, Burns & Crain, Ltd.

[57] ABSTRACT

A torso-conforming diver's weight pouch for use by a diver in a buoyancy compensator vest containing at least one recess. At least one weight for neutralizing the diver's buoyancy is contained within a pocket on the pouch. Attached to the pouch is a curvature retaining device which defines and retains a curved configuration of the pouch. The diver can manipulate the curvature retaining device to determine the pouch's configuration. Such configuration can be changed to conform to the diver's hips. Therefore, when the pouch is installed into a buoyancy jacket, the pouch provides more comfort to the diver.

18 Claims, 3 Drawing Sheets

TORSO-CONFORMING RELEASABLE DIVER'S WEIGHT POUCH

BACKGROUND OF THE INVENTION

The present invention relates generally to releasable diver's weight pouches, and specifically to such pouches having a curvature retaining device with the ability to bend to conform to the diver's hip when used in a buoyancy compensator vest.

Underwater diving preferentially requires the use of a buoyancy compensator vest having an inflatable bladder to provide for buoyancy trim or compensation to a diver. Buoyancy compensators are inflated by oral power or compressed gas obtained through the diver's air tank. When inflated, the buoyancy compensator vest provides the diver with increased buoyancy at greater depths to overcome the fact that a diver's buoyancy decreases with depth. This is because with greater pressure, a loss takes place regarding the lifting characteristics of the diver's buoyancy, primarily due to compression of his wet suit and associated diving equipment.

Conversely, as the diver ascends or approaches the surface, his buoyancy increases as the compression of his wet suit and other equipment recovers. As inherent buoyancy is regained, air must be released from the buoyancy compensator to return the system to neutral buoyancy.

Thus, by increasing or decreasing the buoyancy provided by the buoyancy compensator, a diver can adjust his buoyancy to a neutral state. This is provided by either adding air to the buoyancy compensator or releasing it. A conventional buoyancy compensator vest is disclosed in commonly assigned U.S. Pat. No. 4,068,657, which is incorporated by reference.

A weight belt is often used to assist in achieving neutral buoyancy. Commonly, this consists of a sturdy, waist mounted belt having heavy metallic (typically lead) weights attached to the belt. In an emergency, it is desirable to release the weights quickly so that the diver can readily return to the surface.

A conventional variation of the weight belt is provided in the form of a harness formed of a belt having attached shoulder straps which prevent the belt and weights from slipping off. The disadvantage of the harness is that, in an emergency, it is difficult to jettison the harness without becoming entangled with the straps.

Various quick release systems have been provided to address the problem of rapid release of diving weights. One such attempt used a bottom opening pocket. Gravity is required for proper operation of these systems, making the operation most effective with the diver's body in the vertical position. However, this is not always the case when the diver is in the water.

In recent years, buoyancy compensators have been combined with a vest configuration designed to hold a diver's backpack that supports a container or tank of pressurized gas on a diver's back. Such a combination is disclosed in commonly assigned U.S. Pat. No. 5,522,679, incorporated by reference. The popular combination of vest, backpack, and buoyancy compensator has made the use of a weight belt somewhat awkward and inconvenient to wear and to operate.

Also, the flexibility of the vest causes the back, waistband, and arm or shoulder openings to collapse, twist and tangle so that the vest or spider is not easily accessible or removable.

U.S. Pat. No. 5,641,247 discloses a buoyancy compensator vest having build-in weight pockets. Weights located in envelopes are removably inserted in the pockets of the vest. However, a drawback of this design is that the weights are often located on or adjacent the diver's hip bone. Through the tightening of the vest and the diver's motion during diving, the presence of the weight adjacent the hip bone causes discomfort. This problem is exacerbated by weights which are typically block-shaped pieces of lead and do not readily conform to the diver's body. Also, individual differences in body size and shape result in conventional vest/backpack/weight retaining units to fit some divers more comfortably than others. There is also an increasing interest in providing diving equipment which comfortably fits female divers.

As a consequence, it is an object of this invention to provide an improved combined buoyancy compensator vest/weight retaining device which accommodates the diver's torso, particularly the hip bone.

It is another object of the present invention to provide an improved buoyancy compensator vest with built-in weights which has a releasable, weight-retaining pouch with a deformable, yet retainable curvature which corresponds to that of the individual diver using the device.

It is a further object of the present invention to provide an improved buoyancy compensator vest with built-in weights located in a releasable weight pouch having a curvature retaining device which causes the weights to move to conform to the individual diver's torso.

BRIEF SUMMARY OF THE INVENTION

The above-listed objects are met or exceeded by the present torso-conforming diver's weight pouch for use by a diver in a buoyancy compensator vest containing at least one recess. At least one and preferably several weights for neutralizing the diver's buoyancy are contained within a pocket on the pouch. Attached to the pouch is a curvature retaining device which defines and retains a curved configuration of the pouch. Divers can manipulate the curvature retaining device to determine the pouch's configuration. Such configuration can be changed to conform to the diver's hips. By providing and maintaining this desired configuration, the curvature retaining device also causes the weights in the pouch to shift and approximate the same curvature. Therefore, when the pouch is inserted into a corresponding recess of a buoyancy jacket, the pouch provides more comfort to the diver.

More specifically, the present invention provides a torso-conforming diver's weight pouch for use by a diver in a buoyancy compensator vest, including a pouch configured for insertion into a corresponding recess of the buoyancy compensator vest, and defining a space for receipt of at least one diving weight, a forming structure for forming the pouch to have a specific curvature and also for maintaining the curvature when the vest bearing the pouch is worn by the diver.

DETAILED DESCRIPTION OF THE INVENTION

Figure 1:
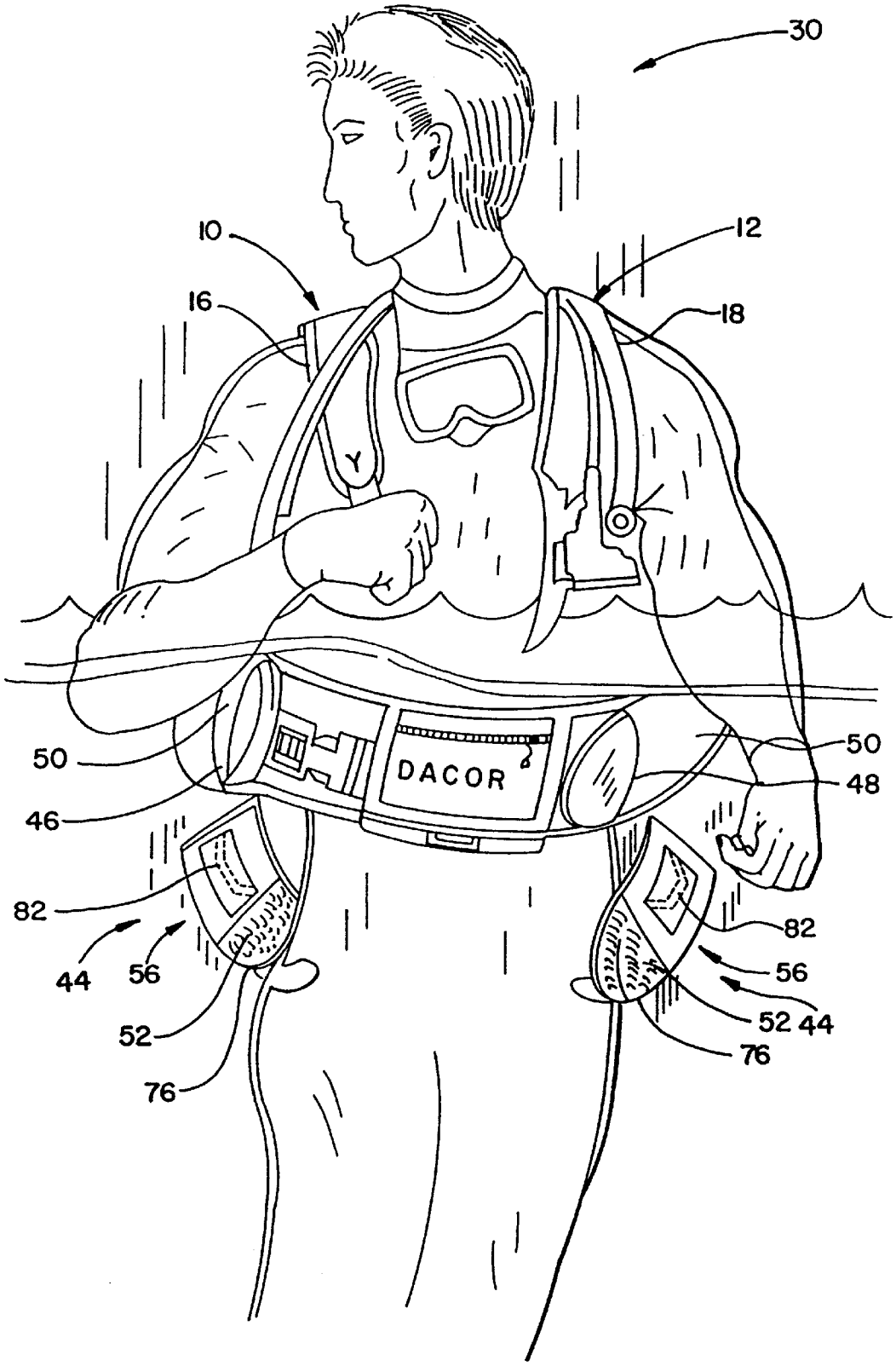
FIG. 1 is an elevational view of a diver wearing a buoyancy compensator vest equipped with the present torso-conforming weight pouch.
Figure 2:
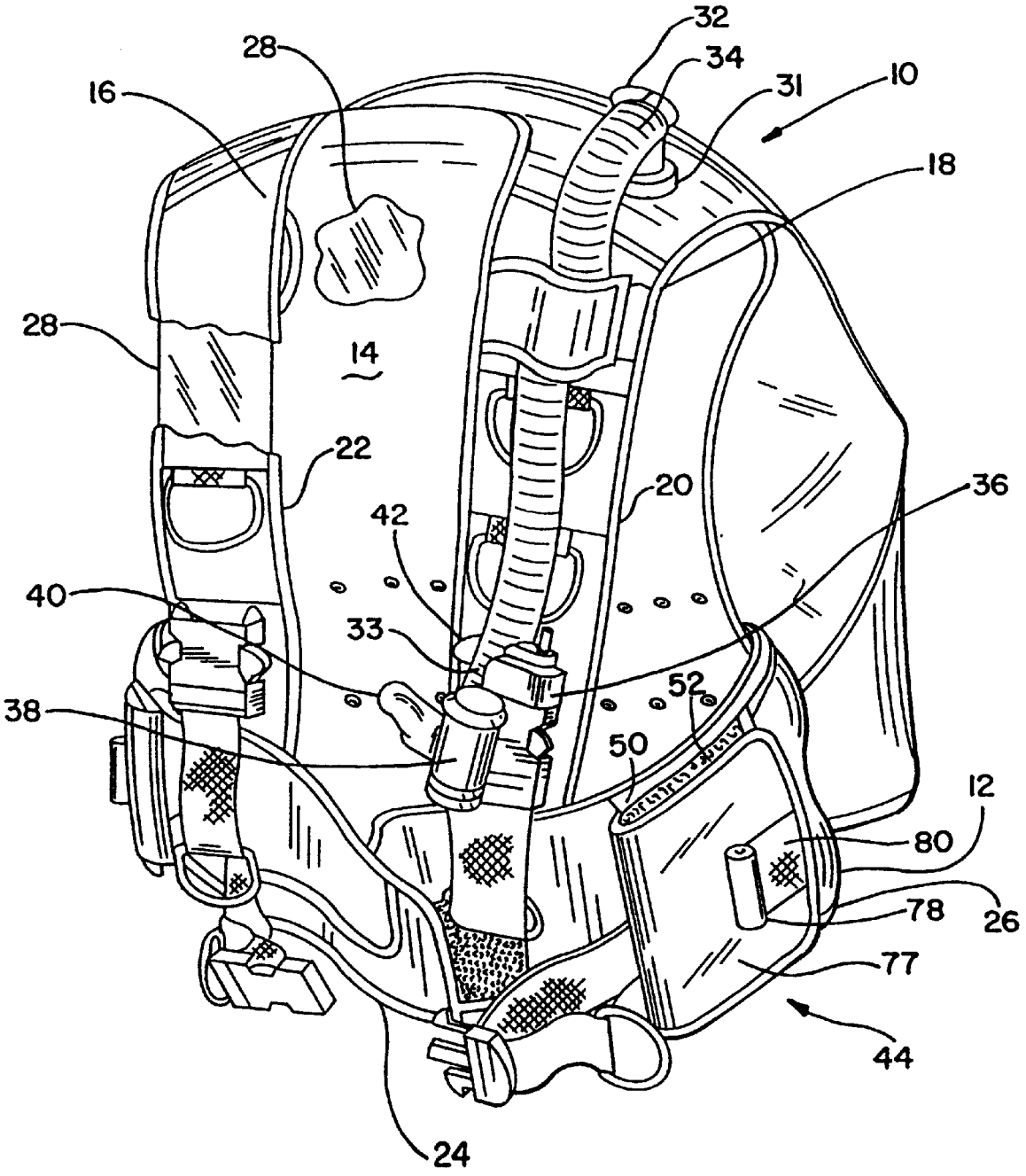
FIG. 2 is a top perspective elevational view of a buoyancy compensator vest of the type shown in FIG. 1.

Referring now to FIGS. 1 and 2, there can be seen the combination buoyancy compensator vest and weight pouch unit of the invention generally designated 10.

Included on the buoyancy compensator unit 10 is a spider or vest 12 having a back portion 14 to which are attached shoulder portions 16 and 18 extending forwardly into chestbands or chest portions 20 and 22. The lower area of the back portion 14 extends forwardly into wide waist portions or waistbands 24 and 26.

The vest 12 can be made of a double layer of material, which preferably includes a stiffening material 28 in one or more of the shoulder areas 16 and 18, in the chestbands or chest portions 20 and 22, in the back portion 14 and in the waist portions or waistbands 24 and 26. The stiffening material 28 is shown in the partially broken away part of chestband 22 (best seen in FIG. 2).

The stiffening material 28 is particularly advantageous in providing a structural integrity or expanded support or shape to the vest 12 so that the combination unit 10 can, at least in part, hold its shape. The stiffening material 28 also allows an extended, unfolded, untwisted and unrestricted arm or shoulder opening. This is particularly desirable for attaching diving accessories to the unit 10, as well as for providing convenience to a diver 30 when putting on the unit 10. The stiffening material 28 can be in the form of a sheet of stiff plastic such as polyethylene, polypropylene or other strong, pliant material which is inserted within and preferably can be stitched or otherwise secured to, or within, the fabric layers of the vest 12. In this manner, a sandwich construction can be achieved.

An opening 31 in the shoulder portion 16 and 18 of the vest 12 enables emplacement of an over pressure release valve 32 which is connected to an inflator tube 34. An end 33 of the inflator tube 34 includes a low pressure inflation valve 36 and an oral inflator 38 having a mouthpiece 40. The low pressure inflation valve 34 is in fluid communication with a pressure line from a tank or cylinder to be held in a backpack (not shown). The valve 36 operates by means of a valve button 42.

The insertable weight system indicated generally at 44 in FIG. 1 is detailed in FIGS. 2 through 6. As shown in FIGS. 1 through 4, recesses 46 and 48 are each preferably formed in the vest 12 by means of a strip of material 50 which is stitched along the parallel lengthwise edges to the exterior of waistbands 24 and 26. The recesses 46 and 48 are formed within the space between the strip of material 50 and the waistbands 24 and 26. It is also contemplated that the recesses may be disposed on other portions of the vest 12, as long as they are quickly accessible by the diver 30.

At least a portion of the exterior of the strip of material 50 is provided with hooks or brushed material 52 in the form of a VELCRO® brand hook and loop attachment system or equivalent.

A pocket 54 for holding weights is provided on a pouch 56. The pocket 54 is formed of a first portion 58 having a flap 60 (best seen in FIG. 6). The first portion 58 is secured to a second portion 62 defining at least one chamber 64 which is closed by the flap 60.

The first portion 58 and the second portion 62 are joined together at corresponding outer edges 65. This can be done by any conventional fastening technology such as by stitching, adhesives, or heat sealing.

In addition, the first portion 58 of material is wider than the second portion 62 of material. The extra material is formed into pleats or gathers 63 which increase the thickness of the chamber 64 for ease in inserting weights.

The interior of the flap 60 and the exterior of the chamber 64 are preferably provided with at least one area of VELCRO® brand hook and lock fastening material 52. Weights are inserted within the chamber 64 and retained by the flap 60.

Figure 4:
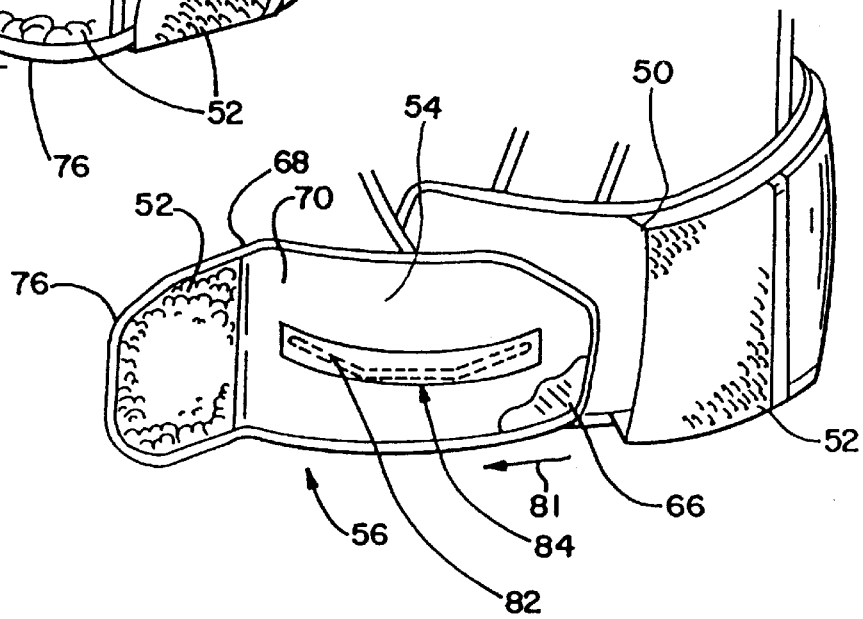
FIG. 4 is a subsequent sequence view of the operation shown in FIG. 3.

Stiffening material 66 as shown in FIG. 4 is preferably disposed on the inside of the chamber 64 secured to an inner surface of the first portion 58 and also in the pouch 56 between a first layer 68 and a second layer 70 of the pouch 56. The portion 62 of the pocket 54 is preferably located on the same piece of material as the first layer 68. Layers 68 and 70 are preferably fastened in back-to-back relationship by stitching, adhesive, hot melt technology, or equivalent. The purpose of the stiffening material 66 is to provide some integrity or rigidity or shape to the pocket 54 and to the pouch 56 for ease of insertion of the weights, and also to make the pouch 56 easily insertable within the recesses 46 or 48. The weights themselves can provide some rigidity if desired.

Also included on the pouch 56 is a flap 76. An inner surface of the flap 76 is also provided with areas of VELCRO® brand hook and loop fastener material for interlocking with the areas of brushed material or hooks 52 on the strip of material 50.

An outer surface 77 of the flap 76 is provided with a knob 78 attached to a fabric tab 80. The tab 80 is stitched or otherwise secured at least in part to the flap 76.

Figure 3:
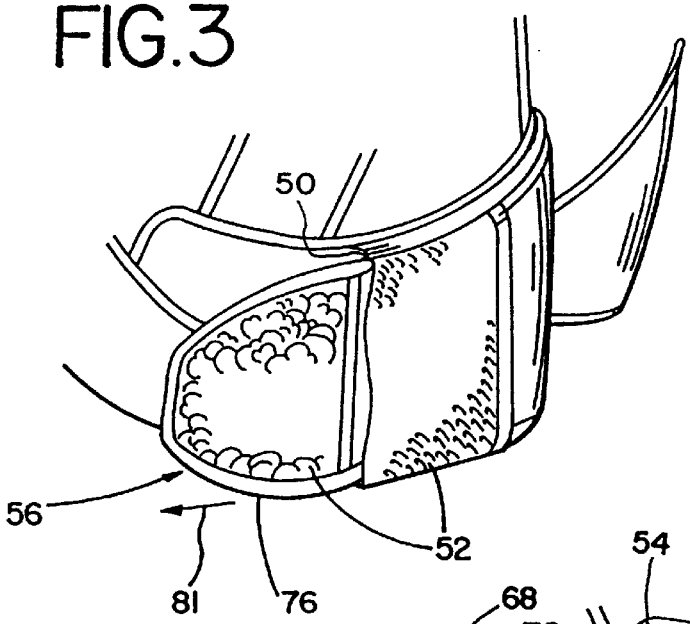
FIG. 3 is a fragmentary perspective view of the vest of FIG. 2 showing the weight pouch becoming detached from the vest.

Referring now to FIG. 1, the diver 30 is shown outfitted in a buoyancy compensator vest 12 from which two torso-conforming weight pouches 56 have been released. FIGS. 2–4 show how the pouch 56 is contained in the recesses 46 and 48 of the buoyancy compensator vest 12, and is removed from the recesses 46 and 48 by pulling on the knob 78 in the direction of the arrow 81. The inserted and closed flap position can be seen in FIG. 2. In order to release the pouch 56, the knob 78 is grasped with one hand and pulled. This releases the interlocking areas of the loop and hook material 52 on the flap 76 and on the strip of material 50 of the buoyancy compensator vest 12 respectively. The first release step is shown in FIG.3. By continuing to pull, the pouch 56 containing weights 83 (FIG. 6) slides out from the recesses 46 and 48 and is allowed to drop away from the diver, as shown in FIGS. 1 and 4.

Figure 5:
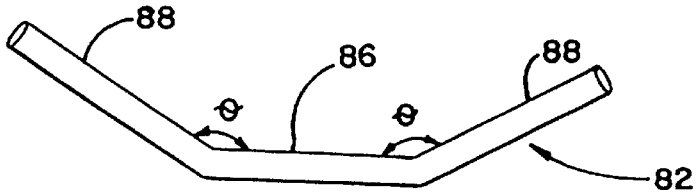
FIG. 5 is an elevational view of the preferred curvature retaining device.
Figure 6:
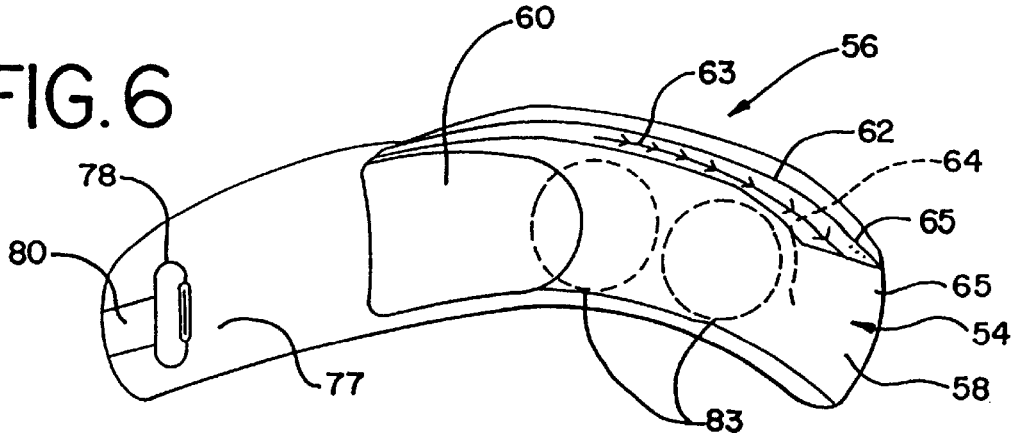
FIG. 6 is a perspective elevational view of the reverse side of the present weight pouch shown in FIG. 4.

Referring now to FIGS. 4 and 5, a rod 82 is provided for forming the pouch 56 into a specific curvature, and for maintaining that curvature when the vest 12 bearing the pouch 56 is worn by the diver 30. FIG. 4 shows how the rod 82, which is preferably totally contained in a fabric sleeve 84, forms the pouch 56 into a curve relative to a longitudinal axis of the pouch. The rod 82 is adjustable or bendable so that the curvature may be changed to suit the diver 30 by varying the shape of the rod 82 to conform to a contour of a hip or other portion of the diver 30.

Referring now to FIG. 1, the diver 30 is outfitted in a buoyancy compensator vest 12 with released torso-conforming weight pouch 56. A pouch 56 is configured for insertion into a corresponding recesses 46 and 48 of the buoyancy compensator vest 12. FIGS. 2–4 show how the pouch 56 is contained in the recesses 46 and 48 of the buoyancy compensator vest 12, and is removed from the recesses 46 and 48. The rod 82 is preferably configured to force the weight 24 to conform to the desired curvature, and thus be more conforming to the diver's torso. In a preferred embodiment of the invention, the rod 82 is made of stainless steel for corrosion protection, and has a center portion 86 and an arm 88 at each opposed end of the center. In the preferred embodiment, the arms 88 define an angle θ with respect to the center portion 88. It is preferred that the angle θ be in the range of 20°, and that similar angles be formed at both ends of the center portion. However, other angular orientations are contemplated, including different angles θ at each end of the center portion.

In use, usually more than one weight 83 is placed in the chamber 64. A feature of the present pouch 56 is that the deformable rod 82 also forces the weights to conform to the desired curvature. Thus, any irritation of the diver's torso or hip bone formerly caused by the weights or the pouch is now reduced.

While a particular embodiment of the torso-conforming weight pouch of the invention has been shown and described, it will be appreciated by those skilled in the art that changes and modifications may be made thereto without departing from the invention in its broader aspects and as set forth in the following claims.

I claim:

1. A torso-conforming diver's weight pouch for use by a diver in a buoyancy compensator vest to conform said pouch to a contour of a portion of the diver's body, said pouch comprising:

said pouch having a longitudinal axis, being configured for insertion into a corresponding recess of the buoyancy compensator vest, and defining a pocket for receipt of at least one diving weight; and forming means disposed on said pouch for forming said pouch to have a specific curvature relative to said longitudinal axis and also for maintaining said curvature when said at least one weight is inserted in said pouch and the vest bearing the pouch is worn by the diver, said forming means being constructed and arranged in said pouch for causing said at least one weight to move in said pocket to conform to said curvature of said forming means.

2. The pouch as defined in claim 1 wherein said forming means includes a rod with an angled shape and a longitudinal axis.

3. The pouch as defined in claim 2 wherein said forming means further includes a sleeve configured for receiving said rod.

4. The pouch as defined in claim 1 wherein said forming means is adjustable so that said curvature may be changed to suit the diver by varying the shape of said forming means.

5. The pouch as defined in claim 2 wherein said forming means is adjustable so that said curvature may be changed to suit the diver by varying the shape of said rod along said longitudinal axis.

6. The pouch as defined in claim 1 wherein said pouch further includes a first side and a second side, and an attaching means on one of said first side and said second side for attaching said pouch to the recess of the buoyancy compensator vest, and a pull knob disposed on said attaching means so that said pouch may be pulled from the recess.

7. A torso-conforming diver's weight pouch for use by a diver in a buoyancy compensator vest having at least one recess, said pouch comprising:

a pouch having a first side, a second side, and a pocket disposed on one of said first side and said second side;

said pocket being configured for receiving at least one weight therein;

a curvature retaining device attached to said pouch for defining and retaining a curvature of said pouch when said at least one weight is inserted in said pocket, said curvature retaining device being constructed and arranged so that said curvature is determinable by the diver and such that the construction and disposition of said curvature retaining device causes said at least one weight to move in said pocket to conform to said curvature.

8. The pouch as defined in claim 7 wherein said pouch has an attaching means on one of said first side and said second side for attaching said pouch to the at least one recess of the buoyancy compensator vest, and a pull knob disposed on said attaching means so that said pouch may be pulled from the recess.

9. The pouch as defined in claim 8 wherein said attaching means includes a portion equipped with VELCRO® brand hook and loop fastener.

10. The pouch as defined in claim 9 wherein said curvature retaining device includes a rod which is bendable to alter said curvature.

11. The pouch as defined in claim 10 wherein said rod has a center portion, and at least one arm disposed at a predetermined angle relative to said center portion.

12. A torso-conforming diver's weight pouch for use by a diver in a buoyancy compensator vest comprising:

a pouch having a first side, a second side, and a pocket disposed on one of said first side and said second sides;

a curvature retaining device attached to said pouch for retaining a curvature of said pouch, said curvature being determinable by the diver;

at least one weight constructed and arranged to fit inside said pocket;

said pocket being configured for receiving said at least one weight;

said curvature retaining device being a rod retained on one of said first and second sides and being sufficiently flexible to be adjustable by the diver, yet being sufficiently stiff to cause said at least one weight to move in said pocket to conform to said curvature.

13. The pouch as defined in claim 12 wherein a weight flap is attached to said weight pocket, to retain said weights therein.

14. The pouch as defined in claim 12 wherein said pocket contains at least one rounded weight.

15. The pouch as defined in claim 12 wherein said curvature retaining device is configured to force said weights to conform to the desired curvature, and thus be more conforming to the diver's torso.

16. A combination torso-conforming diver's weight pouch and buoyancy compensator vest worn by a diver having a torso, said combination comprising:

a buoyancy compensator vest having at least one recess;

at least one diving weight;

a pouch having a longitudinal axis, being configured for insertion into said at least one corresponding recess in said buoyancy compensator vest, and defining a pocket for receipt of said at least one diving weight;

forming means disposed on said pouch for forming said pouch to have a specific curvature and also for maintaining said curvature when said vest bearing the pouch is worn by the diver, said forming means including a rod being configured and disposed in said pouch for causing said at least one weight to move in said pocket to maintain said curvature, and thus being in a more conforming position to the torso.

17. The combination as defined in claim 16 wherein said rod includes a center, and at least one arm disposed at a predetermined angle relative to said center.

18. The combination as defined in claim 17 wherein said angle is in the range of 20°.

* * * * *